US010975637B2

(12) United States Patent
Pilgrim et al.

(10) Patent No.: US 10,975,637 B2
(45) Date of Patent: Apr. 13, 2021

(54) JOINT RECOGNITION SYSTEM

(71) Applicant: Ensco International Incorporated, Wilmington, DE (US)

(72) Inventors: Rick Pilgrim, Magnolia, TX (US); Stephen Joseph DeLory, Conroe, TX (US); Richard Robert Roper, Katy, TX (US)

(73) Assignee: Ensco International Incorporated, Wilmington, DE (US)

( * ) Notice: Subject to any disclaimer, the term of this patent is extended or adjusted under 35 U.S.C. 154(b) by 116 days.

(21) Appl. No.: 15/879,037

(22) Filed: Jan. 24, 2018

(65) Prior Publication Data

US 2018/0216424 A1 Aug. 2, 2018

Related U.S. Application Data

(60) Provisional application No. 62/449,853, filed on Jan. 24, 2017.

(51) Int. Cl.

| | |
|---|---|
| ***E21B 19/16*** | (2006.01) |
| ***E21B 41/00*** | (2006.01) |
| ***E21B 19/10*** | (2006.01) |
| *E21B 19/06* | (2006.01) |
| *E21B 17/042* | (2006.01) |

(52) U.S. Cl.

CPC ..... *E21B 19/165* (2013.01); *E21B 19/10* (2013.01); *E21B 19/161* (2013.01); *E21B 41/0092* (2013.01); *E21B 17/042* (2013.01); *E21B 19/06* (2013.01)

(58) Field of Classification Search

CPC ..... E21B 17/042; E21B 19/06; E21B 19/10; E21B 19/161; E21B 19/165; E21B 41/0092

See application file for complete search history.

(56) References Cited

U.S. PATENT DOCUMENTS 4,365,402 A * 12/1982 McCombs ..... B25B 23/14 173/182
5,461,905 A * 10/1995 Penisson ..... G01M 3/36 73/46

(Continued)

FOREIGN PATENT DOCUMENTS

| | | |
|---|---|---|
| WO | 2016197255 | 12/2016 |
| WO | 2017127924 | 8/2017 |
| WO | 2017193217 | 11/2017 |

OTHER PUBLICATIONS

PCT Application No. PCT/US2018/015066 International Search Report and Written Opinion, dated May 2, 2018, 13 pgs.

*Primary Examiner* — Christopher J Sebesta
(74) *Attorney, Agent, or Firm* — Fletcher Yoder, P.C.

(57) ABSTRACT

Techniques and systems to provide automatic positioning of a tripping apparatus. A system may include a sensor configured to detect a physical characteristic of a tubular string moving past the sensor and generate a signal indicative of the physical characteristic. The system may also include a processing device configured to process the signal indicative of the physical characteristic, determine whether the processed signal is indicative of a deviation of the tubular string, and generate output data utilized to automatically position a tripping apparatus at a location of the deviation on the tubular string.

19 Claims, 5 Drawing Sheets

(56) References Cited

U.S. PATENT DOCUMENTS

| | | | | |
|---|---|---|---|---|
| 9,322,950 | B2 | 4/2016 | Gustavsson et al. | |
| 2006/0114964 | A1* | 6/2006 | Dishaw | E21B 19/165 374/4 |
| 2011/0120730 | A1* | 5/2011 | Clasen | E21B 19/165 166/381 |
| 2013/0008644 | A1* | 1/2013 | Huseman | E21B 19/14 166/250.01 |
| 2013/0271576 | A1* | 10/2013 | Ellis | G06F 17/5009 348/46 |
| 2013/0345878 | A1* | 12/2013 | Austefjord | B66C 13/02 700/275 |
| 2014/0124218 | A1* | 5/2014 | Pilgrim | E21B 44/02 166/380 |
| 2015/0101826 | A1* | 4/2015 | Gupta | E21B 19/164 166/377 |
| 2016/0017674 | A1 | 1/2016 | Richardson et al. | |
| 2016/0194950 | A1 | 7/2016 | Zheng et al. | |
| 2019/0004882 | A1 | 1/2019 | Martin et al. | |

* cited by examiner

JOINT RECOGNITION SYSTEM

CROSS REFERENCE TO RELATED APPLICATIONS

This application is a Non-Provisional Application claiming priority to U.S. Provisional Patent Application No. 62/449,853, entitled "Joint Recognition System", filed Jan. 24, 2017, which is herein incorporated by reference.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Advances in the petroleum industry have allowed access to oil and gas drilling locations and reservoirs that were previously inaccessible due to technological limitations. For example, technological advances have allowed drilling of offshore wells at increasing water depths and in increasingly harsh environments, permitting oil and gas resource owners to successfully drill for otherwise inaccessible energy resources. Likewise, drilling advances have allowed for increased access to land based reservoirs.

Much of the time spent in drilling to reach these reservoirs is wasted "non-productive time" (NPT) that is spent in doing activities which do not increase well depth, yet may account for a significant portion of costs. For example, when drill pipe is pulled out of or lowered into a previously drilled section of well it is generally referred to as "tripping." Accordingly, tripping-in may include lowering drill pipe into a well (e.g., running in the hole or RIH) while tripping-out may include pulling a drill pipe out of the well (pulling out of the hole or POOH). Tripping operations may be performed to, for example, installing new casing, changing a drill bit as it wears out, cleaning and/or treating the drill pipe and/or the wellbore to allow more efficient drilling, running in various tools that perform specific jobs required at certain times in the oil well construction plan, etc. Additionally, tripping operations may require a large number of threaded pipe joints to be disconnected (broken-out) or connected (made-up). Currently, this process involves visual inspection by a human operator to locate a seam (e.g., a break point between pipe segments) and may further include human fine tuning of the position of the seam into an appropriate location so that the tripping operation may be undertaken.

DETAILED DESCRIPTION

Figure 1:
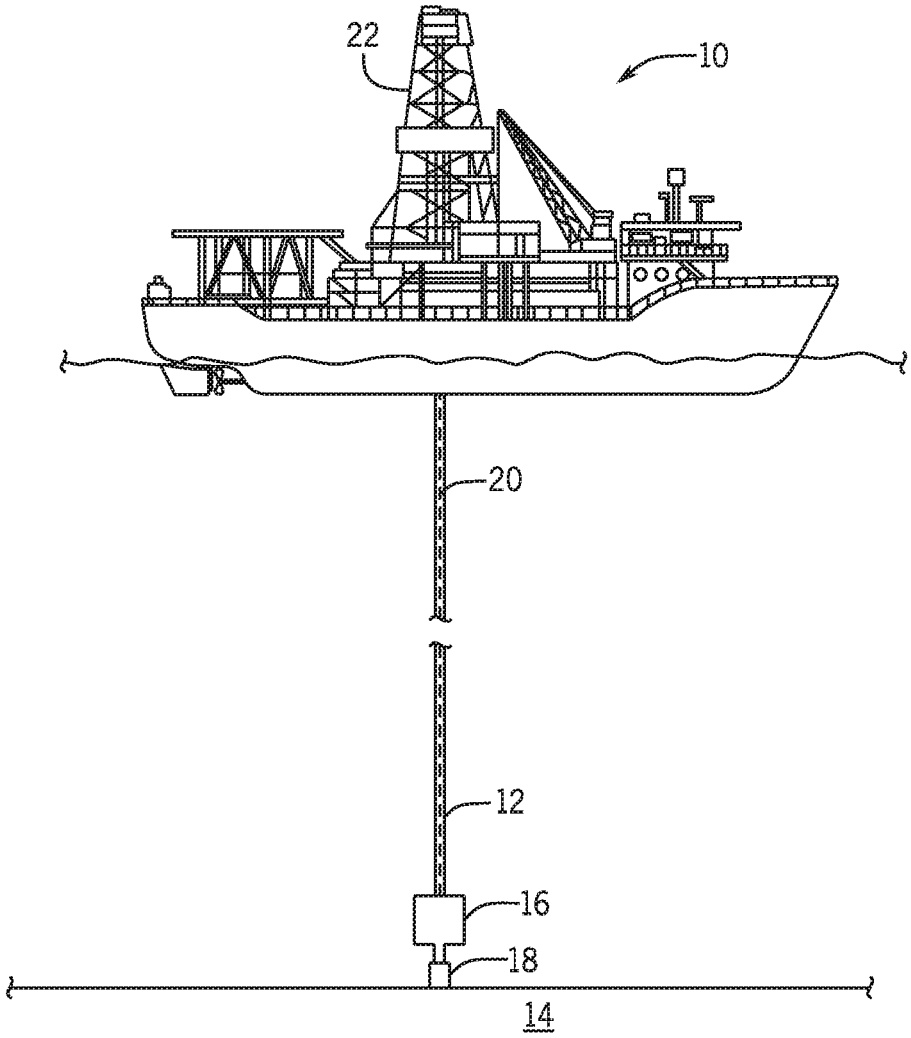
FIG. 1 illustrates an example of an offshore platform having a riser coupled to a blowout preventer (BOP), in accordance with an embodiment.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Present embodiments are directed to components, systems, and techniques (e.g., a position determination system) utilized in the detection of connection points between individual tubulars, such as those used in oil and gas applications. The detection of connection points may be accomplished through the use of a hardware suite of one or more sensors and processors, as well as a suite of one or more software programs (e.g., instructions configured to be executed by a processor, whereby the instructions are stored on a tangible, non-transitory computer-readable medium such as memory) that may operate in conjunction to determine the precise position of the connection point between tubulars.

Additionally, in some embodiments, the software program(s) may be utilized, for example, in conjunction with hardware components (e.g., one or more processors and sensors) to employ a technique of successive refinement of position of the one or more tubulars. For example, an initial tool joint seam location may be calculated using stored information about the tubular string and current position of the tubular string. Additionally, further refinement may be achieved when a connection point passes through one or more (e.g., a set of sensors) that detect the initial presentation or another indicator of the connection point. Final and precise positioning may then be obtained using one or more (e.g., a set of sensors) that precisely measure the connection point location.

In one embodiment, final positioning of the tubular may be determined using a set of optical sensors, such as laser ranging sensors, arranged in a partial or full circumferential manner about the tubular string (e.g., a drill string) and directed towards the string. These sensors may be attached to a moving platform or, in another embodiment, sensors may be attached to additional equipment (e.g., a roughneck) that moves vertically (e.g., relative to a platform).

The determination of the location of the measured tubular may be represented as a vector [z,t], where, for example, z is location of the center of the seam on the z-axis of the moving platform frame of reference, and t is the time. Conversion of position to another frame of reference, such as the drill floor, may also be accomplished, for example, by an external computing system or via the position determination system itself. Likewise, in some embodiments, no additional conversion may be required if the vector [z,t] is determined using a fixed location, such that z is location of the center of the seam on the z-axis of the moving platform frame of reference, and t is the time. Thus, the position determination system can be utilized when it is in absolute or in relative motion with respect to the tubular, or when it is stationary. Additionally, a global (e.g., an absolute) vector [z, t] may also be a combination of reference frames, for example, a moving roughneck plus a moving hoisting system plus a heaving rig. Further, [z] position for each reference frame may be negative or positive and may themselves be calculated from other motions such as pitch and roll within the respective reference frame.

With the foregoing in mind, FIG. 1 illustrates an offshore platform 10 as a drillship. Although the presently illustrated embodiment of an offshore platform 10 is a drillship (e.g., a ship equipped with a drilling system and engaged in offshore oil and gas exploration and/or well maintenance or completion work including, but not limited to, casing and tubing installation, subsea tree installations, and well capping), other offshore platforms 10 such as a semi-submersible platform, a spar platform, a floating production system, or the like may be substituted for the drillship. Indeed, while the techniques and systems described below are described in conjunction with a drillship, the techniques and systems are intended to cover at least the additional offshore platforms 10 described above. Likewise, while an offshore platform 10 is illustrated and described in FIG. 1, the techniques and systems may also be applied to and utilized in onshore drilling activities.

As illustrated in FIG. 1, the offshore platform 10 includes a riser string 12 extending therefrom. The riser string 12 may include a pipe or a series of pipes that connect the offshore platform 10 to the seafloor 14 via, for example, a BOP 16 that is coupled to a wellhead 18 on the seafloor 14. In some embodiments, the riser string 12 may transport produced hydrocarbons and/or production materials between the offshore platform 10 and the wellhead 18, while the BOP 16 may include at least one BOP stack having at least one valve with a sealing element to control wellbore fluid flows. In some embodiments, the riser string 12 may pass through an opening (e.g., a moonpool) in the offshore platform 10 and may be coupled to drilling equipment of the offshore platform 10. As illustrated in FIG. 1, it may be desirable to have the riser string 12 positioned in a vertical orientation between the wellhead 18 and the offshore platform 10 to allow a drill string made up of drill pipes 20 to pass from the offshore platform 10 through the BOP 16 and the wellhead 18 and into a wellbore below the wellhead 18. Also illustrated in FIG. 1 is a drilling rig 22 (e.g., a drilling package or the like) that may be utilized in the drilling and/or servicing of a wellbore below the wellhead 18.

Figure 2:
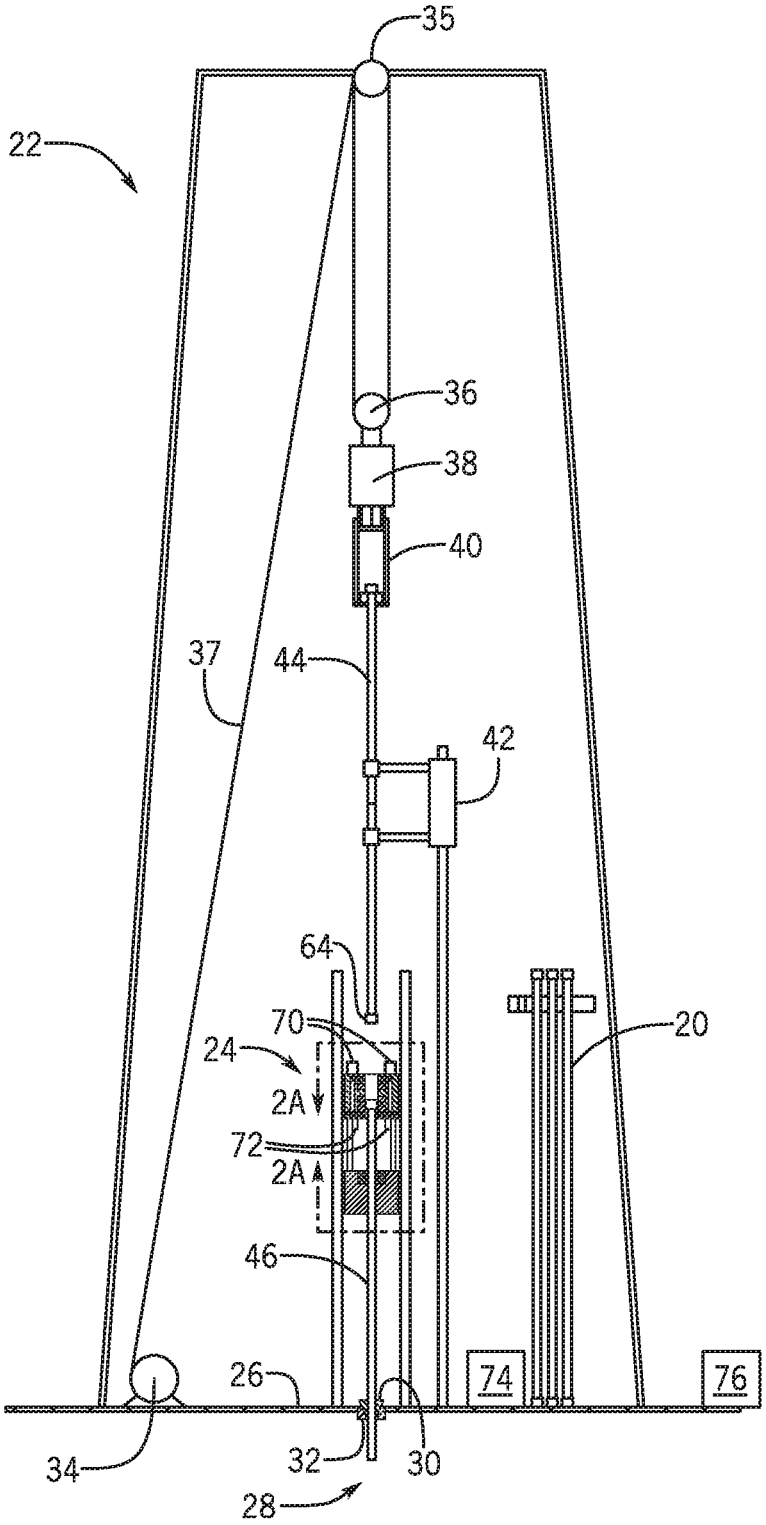
FIG. 2 illustrates a front view a drill rig as illustratively presented in FIG. 1, in accordance with an embodiment.

In a tripping-in operation consistent with embodiments of the present disclosure, as depicted in FIG. 2, a tripping apparatus 24 is positioned on drilling floor 26 in the drilling rig 22 above the wellbore 28 (e.g., the drilled hole or borehole of a well which may be, as illustrated in FIG. 2, proximate to the drilling floor 26 or which may be, in conjunction with FIG. 1, below the wellhead 18). The drilling rig 22 may include one or more of, for example, the tripping apparatus 24, floor slips 30 positioned in rotary table 32, drawworks 34, a crown block 35, a travelling block 36, a top drive 38, an elevator 40, and a tubular handling apparatus 42. The tripping apparatus 24 may operate to couple and decouple tubular segments (e.g., drill pipe 20 to and from a drill string) while the floor slips 30 may operate to close upon and hold a drill pipe 20 and/or the drill string passing into the wellbore 28. The rotary table 32 may be a rotatable portion of the drilling floor 26 that may operate to impart rotation to the drill string either as a primary or a backup rotation system (e.g., a backup to the top drive 38).

The drawworks 34 may be a large spool that is powered to retract and extend drilling line 37 (e.g., wire cable) over a crown block 35 (e.g., a vertically stationary set of one or more pulleys or sheaves through which the drilling line 37 is threaded) and a travelling block (e.g., a vertically movable set of one or more pulleys or sheaves through which the drilling line 37 is threaded) to operate as a block and tackle system for movement of the top drive 38, the elevator 40, and any tubular segment (e.g., drill pipe 20) coupled thereto. The top drive 38 may be a device that provides torque to (e.g., rotates) the drill string as an alternative to the rotary table 32 and the elevator 40 may be a mechanism that may be closed around a drill pipe 20 or other tubular segments (or similar components) to grip and hold the drill pipe 20 or other tubular segments while those segments are moving vertically (e.g., while being lowered into or raised from the wellbore 28). The tubular handling apparatus 42 may operate to retrieve a tubular segment from a storage location (e.g., a pipe stand) and position the tubular segment during tripping-in to assist in adding a tubular segment to a tubular string. Likewise, the tubular handling apparatus 42 may operate to retrieve a tubular segment from a tubular string and transfer the tubular segment to a storage location (e.g., a pipe stand) during tripping-out to remove the tubular segment from the tubular string.

Figure 2A:
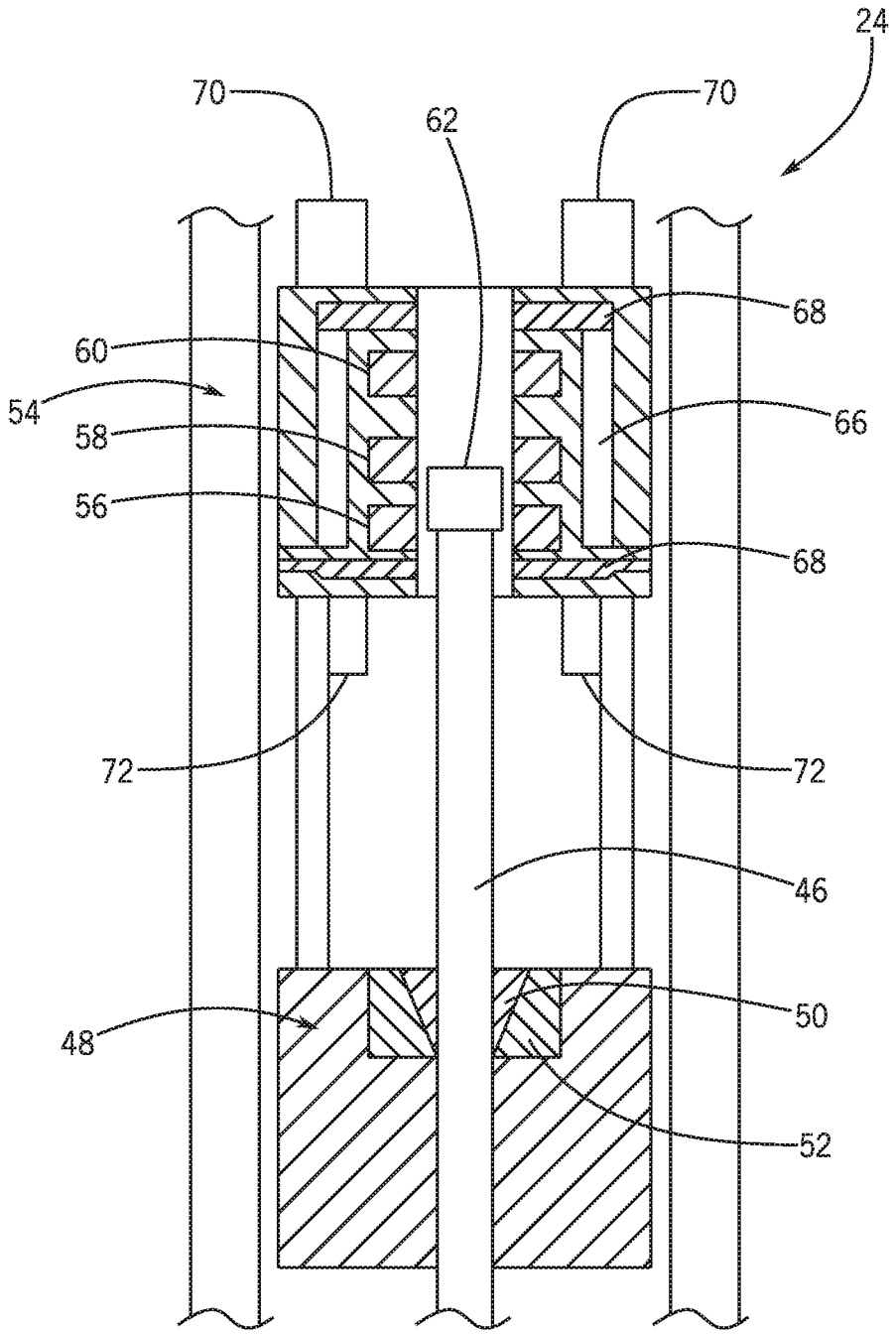
FIG. 2A illustrates a front view of the tripping apparatus of FIG. 2, in accordance with an embodiment.

During a tripping-in operation, the tubular handling apparatus 42 may position a first tubular segment 44 (e.g., a first drill pipe 20) so that the first tubular segment 44 may be grasped by the elevator 40. Elevator 40 may be lowered, for example, via the block and tackle system towards the tripping apparatus 24 to be coupled to a second tubular segment 46 (e.g., a second drill pipe 20) as part of a drill string. As illustrated in FIG. 2A, the tripping apparatus 24 may include tripping slips 48 inclusive of slip jaws 50 that engage and hold the segment 46 as well as a forcing ring 52 that operates to provide force to actuate the slip jaws 50. The tripping slips 48 may, thus, be activated to grasp and support the first tubular segment 44, and, accordingly, an associated tubular string (e.g., drill string) when the tubular string is disconnected from block and tackle system. The tripping slips 48 may be actuated hydraulically, electrically, pneumatically, or via any similar technique.

The tripping apparatus 24 may further include a roughneck 54 (such as an iron roughneck) that may operate to selectively make-up and break-out a threaded connection between first and second tubular segments 44 and 46 in a tubular string. In some embodiments, the roughneck 54 may include one or more of fixed jaws 56, makeup/breakout jaws 58, and a spinner 60. In some embodiments, the fixed jaws 56 may be positioned to engage and hold the second (lower) tubular segment 46 below a threaded joint 62 thereof. In this manner, when the first (upper) tubular segment 44 is positioned coaxially with the second tubular segment 46 in the tripping apparatus 24, the second tubular segment 46 may be held in a stationary position to allow for the connection of the first tubular segment 44 and the second tubular segment 46 (e.g., through connection of the threaded joint 62 of the second tubular segment 46 and a threaded joint 64 of the first tubular segment 44).

To facilitate this connection, the spinner 60 and the makeup/breakout jaws 58 may provide rotational torque. For example, in making up the connection, the spinner 60 may engage the first tubular segment 44 and provide a relatively high-speed, low-torque rotation to the first tubular segment 44 to connect the first tubular segment 44 to the second segment 46. Likewise, the makeup/breakout jaws 58 may engage the first tubular segment 44 and may provide a relatively low-speed, high-torque rotation to the first tubular segment 44 to provide, for example, a rigid connection between the first and second tubular segments 44 and 46. Furthermore, in breaking-out the connection, the makeup/breakout jaws 58 may engage the first tubular segment 44 and impart a relatively low-speed, high-torque rotation on the first tubular segment 44 to break the rigid connection. Thereafter, the spinner 60 may provide a relatively high-speed, low-torque rotation to the first tubular segment 44 to disconnect the first tubular segment 44 from the second segment 46.

In some embodiments, the roughneck 54 may further include a mud bucket 66 that may operate to capture drilling fluid, which might otherwise be released during, for example, the break-out operation. In this manner, the mud bucket 66 may operate to prevent drilling fluid from spilling onto drill floor 26. In some embodiments, the mud bucket 66 may include one or more seals 68 that aid in fluidly sealing the mud bucket 66 as well as a drain line that operates to allow drilling fluid contained within mud bucket 66 to return to a drilling fluid reservoir.

The roughneck 54 be vertically movable with respect to the drill floor 26 and, in some embodiments, relative to the tripping slips 48. Movement of the roughneck 54 may accomplished through the use of hydraulic pistons, jack-screws, racks and pinions, cable and pulley, a linear actuator, or the like. This movement may be beneficial to aid in proper location of the roughneck 54 during a make-up or break-out operation (e.g., during a tripping-in or tripping-out operation). Accordingly, one or more sensors 70 and 72 may be provided in conjunction with the tripping apparatus 24 (e.g., as a portion of the tripping apparatus 24 or adjacent to and to be utilized with the tripping apparatus 24). In some embodiments, the one or more sensors 70 may be utilized in conjunction with a make-up (e.g., a tripping-in) operation while the one or more sensors 72 may be utilized in conjunction with a break-out (e.g., a tripping-out) operation. Alternatively, both sets of sensors 70 and 72 may be utilized together in conjunction with either or both tripping operations.

The types of sensors 70 and 72 may include, but are not limited to, cameras (e.g., high frame rate cameras), lasers (e.g., multi-dimensional lasers), transducers (e.g., ultrasound transducers), electrical and or magnetic characteristic sensors (e.g., sensors that can measure/infer capacitance, inductance, magnetism, or the like), chemical sensors, metallurgical detection sensors, or the like. The sensors 70 and 72 may be utilized to discern, either directly or indirectly, single or combinations of known attribute(s) of a tubular segment (e.g., segment 44 or 46). These attributes can be, but are not limited to, surface text/color, profiles, inner physical structures, electromagnetic characteristics, etc.

As illustrated in each of FIGS. 2 and 2A, one or more sensors 70 may be positioned vertically above (with respect to the drill floor 26) and at the top of a make/break assembly (e.g., one or more of the makeup/breakout jaws 58 and the spinner 60) of the roughneck 54. Likewise, one or more sensors 72 may be positioned vertically below (with respect to the drill floor 26) and at the bottom of a make/break assembly (e.g., one or more of the makeup/breakout jaws 58 and the spinner 60) of the roughneck 54. In some embodiments, the one or more sensors 70 may be used in conjunction with a tripping-in operation (e.g., a make-up operation), as one or more sensors 70 will be proximate to the tubular segments as they move in a downwards direction towards the drill floor 26 as the tubular segments enter the tripping apparatus 24. Likewise, the one or more sensors 72 may be used in conjunction with a tripping-out operation (e.g., a break-out operation), as one or more sensors 70 will be proximate to the tubular segments as they move in an upwards direction away from the drill floor 26 as the tubular segments enter the tripping apparatus 24. However, the utilization of the one or more sensors 70 in conjunction with a tripping-out operation (e.g., a break-out operation) or the utilization of the one or more sensors 72 in conjunction with a tripping-in operation (e.g., a make-up operation) or utilization of both of the sensors 70 and 72 with one or both of a tripping-out operation (e.g., a break-out operation) and a tripping-in operation (e.g., a make-up operation) is also envisioned. Likewise, embodiments wherein only one of the one or more sensors 70 and 72 are present are envisioned. Additionally, as illustrated in FIG. 2, a computing system 74 may be present and may operate in conjunction with the one or more sensors 70 and 72 as described in greater detail below with respect to FIGS. 3 and 4.

Figure 3:
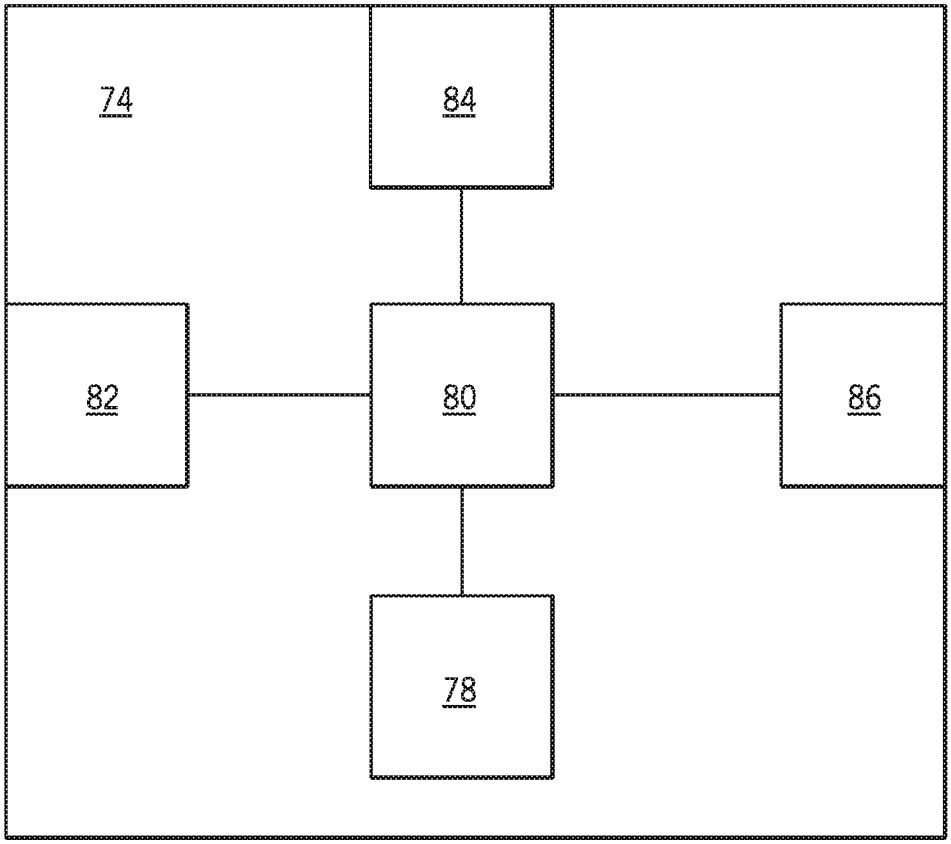
FIG. 3 illustrates a block diagram of a computing system of FIG. 2, in accordance with an embodiment.

FIG. 3 illustrates the computing system 74. It should be noted that the computing system 74 may be a standalone unit (e.g., a control monitor) that operates in conjunction with the one or more sensors 70 and 72 (e.g., to form a control system). Likewise, the computing system 74 may be configured to operate in conjunction with one or more of the tripping apparatus 24 and/or the tubular handling apparatus 42. In some embodiments, the computing system 74 may be communicatively coupled to a separate main control system 76, for example, a control system in a driller's cabin that may provide a centralized control system for drilling controls, automated pipe handling controls, and the like. In other embodiments, the computing system may be portion of the main control system 76 (e.g., the control system present in the driller's cabin).

The computing system 74 may operate in conjunction with software systems implemented as computer executable instructions stored in a non-transitory machine readable medium of computing system 74, such as memory 78, a hard disk drive, or other short term and/or long term storage. Particularly, the techniques to receive sensor information (e.g., signals) from the one or more sensors 70 and 72 and generate indications of joints or the like may based on the information be implemented through the use of the computing system 74, fore example, using code or instructions stored in a non-transitory machine readable medium of computing system 74 (such as memory 78) and may be executed, for example, by a processing device 80 or a controller of computing system 74.

Thus, the computing system 74 may be a general purpose or a special purpose computer that includes a processing device 80, such as one or more application specific integrated circuits (ASICs), one or more processors, or another processing device that interacts with one or more tangible, non-transitory, machine-readable media (e.g., memory 78) of the computing system 74 that collectively stores instructions executable by the processing device 80 to perform the methods and actions described herein. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by the processing device 80. In some embodiment, the instructions executable by the processing device 80 are used to generate, for example, control signals to be transmitted to, for example, one or more of the tripping apparatus 24 (e.g., the roughneck 54 and/or one or more of the fixed jaws 56, the makeup/breakout jaws 58, and the spinner 60), the tubular handling apparatus 42, the one or more sensors 70 and 72, or the main control system 76 (e.g., to be utilized in the control of the tripping apparatus 24, the roughneck 54, the fixed jaws 56, the makeup/breakout jaws 58, the spinner 60, the tubular handling apparatus 42, and/or the one or more sensors 70 and 72) to operate in a manner described herein.

The computing system 74 may also include one or more input structures 82 (e.g., one or more of a keypad, mouse, touchpad, touchscreen, one or more switches, buttons, or the like) to allow a user to interact with the computing system 74, for example, to start, control, or operate a graphical user interface (GUI) or applications running on the computing system 74 and/or to start, control, or operate the tripping apparatus 24 (e.g., the roughneck 54 and/or one or more of the fixed jaws 56, the makeup/breakout jaws 58, and the spinner 60), the tubular handling apparatus 42, and/or the one or more sensors 70 and 72. Additionally, the computing system 74 may include a display 84 that may be a liquid crystal display (LCD) or another type of display that allows users to view images generated by the computing system 74. The display 84 may include a touch screen, which may allow users to interact with the GUI of the computing system 74. Likewise, the computing system 74 may additionally and/or alternatively transmit images to a display of the main control system 76, which itself may also include a non-transitory machine readable medium, such as memory 78, a processing device 80, one or more input structures 82, a display 84, and/or a network interface 86.

Returning to the computing system 74, as may be appreciated, the GUI may be a type of user interface that allows a user to interact with the computer system 74 and/or the computer system 74 and the one or more sensors 70 and 72 (e.g., the control system) through, for example, graphical icons, visual indicators, and the like. Additionally, the computer system 74 may include network interface 86 to allow the computer system 74 to interface with various other devices (e.g., electronic devices). The network interface 86 may include one or more of a Bluetooth interface, a local area network (LAN) or wireless local area network (WLAN) interface, an Ethernet or Ethernet based interface (e.g., a Modbus TCP, EtherCAT, and/or ProfiNET interface), a field bus communication interface (e.g., Profibus), a/or other industrial protocol interfaces that may be coupled to a wireless network, a wired network, or a combination thereof that may use, for example, a multi-drop and/or a star topology with each network spur being multi-dropped to a reduced number of nodes.

In some embodiments, one or more of the tripping apparatus 24 (and/or a controller or control system associated therewith), the tubular handling apparatus 42 (and/or a controller or control system associated therewith), the one or more sensors 70, the one or more sensors 72, and the main control system 76 may each be a device that can be coupled to the network interface 86. In some embodiments, the network formed via the interconnection of one or more of the aforementioned devices should operate to provide sufficient bandwidth as well as low enough latency to exchange all required data within time periods consistent with any dynamic response requirements of all control sequences and closed-loop control functions of the network and/or associated devices therein. It may also be advantageous for the network to allow for sequence response times and closed-loop performances to be ascertained, the network components should allow for use in oilfield/drillship environments (e.g., should allow for rugged physical and electrical characteristics consistent with their respective environment of operation inclusive of but not limited to withstanding electrostatic discharge (ESD) events and other threats as well as meeting any electromagnetic compatibility (EMC) requirements for the respective environment in which the network components are disposed). The network utilized may also provide adequate data protection and/or data redundancy to ensure operation of the network is not compromised, for example, by data corruption (e.g., through the use of error detection and correction or error control techniques to obviate or reduce errors in transmitted network signals and/or data).

Figure 4:
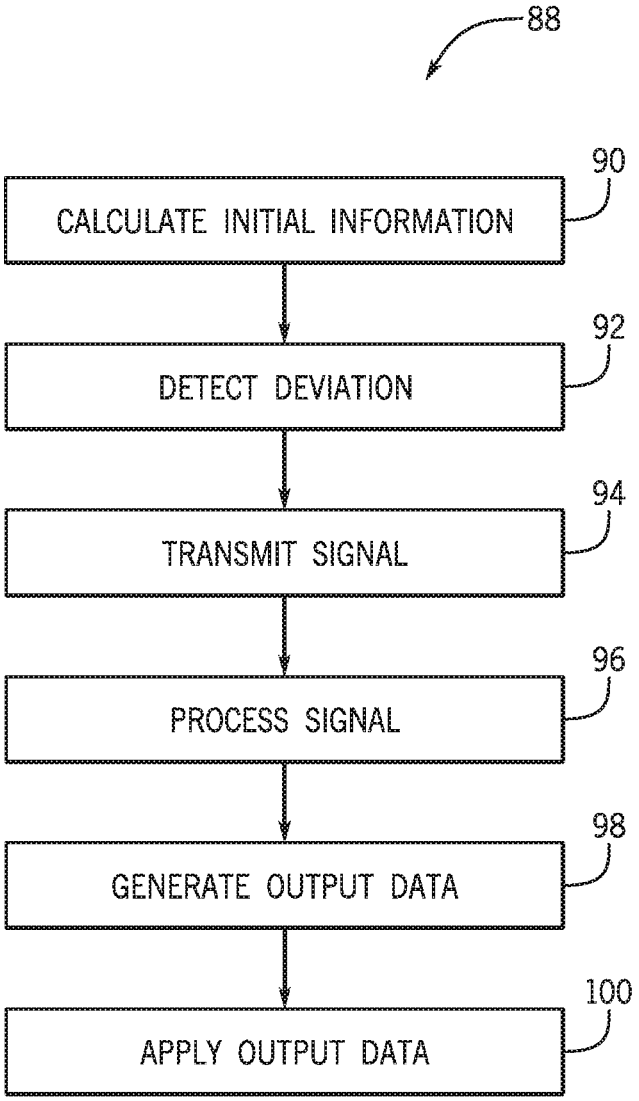
FIG. 4 illustrates a flow chart used in conjunction with a tubular string detector, in accordance with an embodiment.

FIG. 4 illustrates a flow chart 88 detailing the operation of a tubular string detection system, which may include the use of the computing system 74 operating in conjunction with one or more of the sensors 70 and 72. It will be noted that the operation will be discussed as utilizing one or more sensors 70. However, this operation may instead utilize one or more sensors 70 and 72 or one or more sensors 72 depending on, for example, a tripping operation being undertaken, the type of deviation in the string to be detected, and/or based on additional factors.

In step 90, initial information may be calculated regarding the tubular string. This initial information may involve calculation of a tubular string seam or other deviation in the string based on initial positioning, movement (e.g., velocity), and/or other factors effecting the tubular string during a tripping operation. This initial information may be useful in determining a rough estimate of the location of the deviation and/or a time until the deviation will enter the tripping apparatus 24 to implement a make-up or break-out operation on the tubular string. In some embodiments, one or more sensors (separate from the one or more sensors 70 and 72) may be located at a fixed location above and/or below the tripping apparatus 24 and may be utilized to sense initial location, speed, or other characteristics of the tubular string as input data for use in step 90 to generate a rough estimate of the location of the seam or other deviation in the string as the initial information regarding the tubular string.

In step 92, the one or more sensors 70 may detect any deviation in an outer dimension of, for example, first tubular segment 44. Indeed, the one or more sensors 70 may have sufficient sensitivity to determine, for example, one ore more of a tool joint upset, a connection seam, or the like as the deviation. In some embodiments, the detection of the deviation may by accomplished through the use of one or more laser ranging sensors as the one or more sensors 70, for example, arranged around the tubular string (e.g., in a circumferential manner about and directed towards the tubular string) and attached to the vertically movable tripping apparatus 24 and/or the vertically movable roughneck 54.

In step 94, the one or more sensors may transmit one or more signals representative of and/or indicative of the detection of the deviation. In some embodiments, these one or more signals may be image data of the deviation for processing. The one or more signals transmitted in step 94 may be received by the computing system 74 for processing by the processing device 80 in step 96.

In some embodiments, this processing in step 96 may include processing of image and/or video data and, accordingly, the processing in step 96 may be performed as, for example, parallel processing of images in multiple processors and/or specialized processors of the computing system 74 as part of or coupled to the a processing device 80, so as to accommodate high frame/data rates of imaging information. In some embodiments, the processing in step 96 may include application of one or more machine vision algorithms and/or computer vision algorithms to provide imaging-based automatic inspection and/or analysis of the tubular string to determine shapes, edges, seams, or the like thereof to process and analyze the received image data, which may then be utilized, for example, in the improved determination of connection points of a tubular string. For example, the processing of the tubular information in step 96 in conjunction with one or more machine vision or computer vision algorithms may include one or more of the following steps or techniques.

Raw ranging data collected by the one or more sensors 70 in step 92 may be transmitted to the computing system 74 for processing by the a processing device 80, for example, in conjunction with a program accessed from non-transitory machine readable medium of computing system 74 (such as memory 78). This data may be converted by the processing device 80 to measurements in a cylindrical coordinate system, with origin location at the center of the tubular and the z-axis oriented vertically up the center of the tubular (e.g., when laser ranging sensors are utilized as the one or more sensors 70; however, other origin locations may be utilized when other optical sensors are utilized for example, as part of optical edge detection). Smoothing calculations, such as moving average routines, may then be applied by the processing device 80 to determine the mean tubular surface, which may be used as a reference. Additionally, a feature set may be determined and developed by processing device 80, whereby the feature set includes features such as difference between tubular segment thicknesses at each z-axis interval and the mean tubular surface. This feature set may be compared by processing device 80 to a predetermined set of values for the feature set known to be consistent with the topology of, for example, one or more given deviation (e.g., a seam or other connection in the tubular string). The results of the comparison may be analyzed (e.g., scored) and if the scoring meets and/or exceeds a predetermined threshold, the deviation (e.g., the seam or other characteristic of the tubular string) is assessed as identified by the processing device 80. In this manner, the received data/one or more signals received from the sensors 70 may be processed in conjunction with step 96.

Based on the processing of the one or more signals in step 96 (e.g., if a seam or other tubular attribute is determined to be present based on the processing of the one or more signals in step 96), processing device 80 may operate to generate output data in step 98 which, in some embodiments, may be transmitted from the computing system 74. This output data may, for example, be a vector [z,t], where z is location of the center of the seam on the z-axis of a moving platform frame of reference (e.g., on or coupled to the tripping apparatus 24), and t is time. Conversion of position to another frame of reference, such as the drill floor 26 may also be generated by the computing system 74, although this calculation may instead be performed separate from the computing system 74, for example, by the main control system 76. Additionally, a global (e.g., an absolute) vector [z, t] may generated as output data and may be a combination of reference frames, for example, a moving roughneck 54 and/or a moving hoisting system and/or a heaving rig. Further, [z] position for each reference frame may be a negative or a positive value and each reference frame may themselves be calculated from other motions, such as pitch and roll within the respective reference frame.

In some embodiments, the output data generated in step 98 may be applied in step 100, for example, to control the movement of the tripping apparatus 24 into position for performance of a making-up or breaking-out operation. That is, the output data may be applied in step 100 to automatically fine-tune movement of the tripping apparatus 24 and/or the roughneck 54 into position for a manually controlled make-up or break-out operation to be undertaken. In other embodiments, the output data generated in step 98 may be applied in step 100, for example, to control the movement of the tripping apparatus 24 into position for performance of a making-up or breaking-out operation and automatically control the operation of the tripping apparatus 24 and/or the roughneck 54 in a make-up or break-out operation. The application of the output data in step 100 may be performed, for example, by the processing device 80 generating one or more control signals to be transmitted for control of the tripping apparatus 24, the roughneck 54, and/or the associated equipment utilized in a tripping operation. In other embodiments, the application of the output data in step 100 may be performed, for example, by the controllers separate from the computing system 74 (e.g., a controller of the tripping apparatus 24) or by the main control system 76. Regardless, through use of the techniques outlined in flow chart 88, for example, hunt and peck type searches for connections of segments of a tubular string may be avoided, thus decreasing the amount of time spent on tripping operations (e.g., make-up and break-out operations).

This written description uses examples to disclose the above description to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiment are to cover all modifications, equivalents, and alternatives falling within the spirit and scope of the embodiments as defined by the following appended claims.

What is claimed is:

1. A system, comprising:

a sensor that when in operation detects a physical characteristic of a tubular string moving past the sensor and generates a signal indicative of the physical characteristic; and a processing device that when in operation:

processes the signal indicative of the physical characteristic to generate a processed signal;

determines whether the processed signal is indicative of a seam or connection of the tubular string by comparison of the processed signal with one or more predetermined values of a thickness of a tubular segment of the tubular string and by determining whether a result of the comparison meets or exceeds a predetermined threshold value; and generates output data comprising position information and a time information each related to the seam or connection of the tubular string as a first reference frame of a plurality of reference frames generated based upon relative movements of respective components of a rig including at least a portion of a lifting system, wherein the output data is utilized to automatically vertically position a tripping apparatus at a location of the seam or connection on the tubular string, vertically position a roughneck of the tripping apparatus relative to a platform of the tripping apparatus comprising tripping slips, and activate the tripping slips to engage the tubular string in conjunction with operation of the roughneck during a tripping operation when the result of the comparison meets or exceeds the predetermined threshold value.

2. The system of claim 1, wherein the processing device is configured to transmit the output data to control operation of a positioning element to position the tripping apparatus at a distance relative to a drill floor as the location.

3. The system of claim 1, wherein the processing device is configured to transmit the output data to control operation of a positioning element to position the tripping apparatus at the location.

4. The system of claim 1, wherein the processing device is configured to generate the output data based on determining that the processed signal is indicative of the seam or connection of the tubular string.

5. The system of claim 1, comprising the tripping apparatus, wherein the tripping apparatus comprises the roughneck configured to make-up and break-out a threaded connection between tubular segments of the tubular string.

6. The system of claim 5, wherein the sensor is disposed vertically above the roughneck relative to a drill floor, wherein the sensor is directly coupled to the tripping apparatus.

7. The system of claim 6, wherein the sensor is configured to detect the physical characteristic of the tubular string moving past the sensor and generate the signal indicative of the physical characteristic during the make-up of the threaded connection between the tubular segments of the tubular string.

8. The system of claim 5, comprising a second sensor configured to detect a second physical characteristic of the tubular string moving past the second sensor and generate a second signal indicative of the second physical characteristic.

9. The system of claim 8, wherein the second sensor is disposed vertically below the roughneck relative to a drill floor, wherein the sensor is directly coupled to the tripping apparatus.

10. The system of claim 9, wherein the second sensor is configured to detect the second physical characteristic of the tubular string moving past the second sensor and generate the second signal indicative of the second physical characteristic during the selective break-out of the threaded connection between the tubular segments of the tubular string.

11. The system of claim 1, wherein the sensor comprises a camera, a laser, a transducer, an electrical characteristic sensor, a magnetic characteristic sensor, a chemical sensor, or a metallurgical detection sensor.

12. A device, comprising:

an input configured to receive a signal indicative of motion of a segment; and a processor that when in operation:

processes the signal indicative of the motion to generate a processed signal; and generates an output indicative of a position, a speed, or an acceleration of a particular portion of the segment to be used in conjunction with a tripping operation of a tubular string comprising the segment based on the processed signal, wherein the input is configured to receive a second signal indicative of detection of a tool joint upset of the segment, wherein the processor when in operation generates a control signal based on position information and a time information each related to the tool joint upset of the segment as a first reference frame of a plurality of reference frames generated based upon relative movements of respective components of a rig including at least a portion of a lifting system, to control vertical movement of a tripping apparatus and control vertical movement of a roughneck of the tripping apparatus relative to a platform of the tripping apparatus comprising tripping slips to position the roughneck to make-up or break-out the segment in conjunction with activation of the tripping slips to engage the segment in conjunction with operation of the roughneck during the tripping operation of the tubular string based upon a result of a comparison between a second processed signal that is based upon the second signal and one or more predetermined values of a thickness of the tubular segment as meeting or exceeding a predetermined threshold value.

13. The device of claim 12, wherein the processor is configured to determine an initial estimate of a location of the tool joint upset of the segment of the tubular string based upon the output.

14. The device of claim 12, wherein the processor is configured to process the second signal to generate the second processed signal used to confirm detection of the location of the tool joint upset.

15. The device of claim 14, wherein the processor is configured to process the second signal by generating a measured feature set based upon the second signal as the second processed signal, comparing the measured feature set against the one or more predetermined values, and analyzing the results of the comparing to determine if the threshold value is met or exceeded as a confirmation of the detection of the location of the tool joint upset.

16. The device of claim 14, wherein the processor is configured to generate a vector value as comprising the position information and the time information.

17. The device of claim 16, wherein the processor is configured to utilize the vector value to generate the control signal.

18. An a pparatus, comprising:

a platform comprising tripping slips and configured to be moved with respect to a drill floor;

a roughneck configured to be coupled to the platform, wherein the roughneck is configured to be vertically moved relative to the platform and the drill floor, wherein the roughneck is configured to make up or break out a segment of a tubular string;

a sensor configured to detect a physical characteristic of a tubular string moving past the sensor and generate a signal indicative of the physical characteristic; and a control system that when in operation generates output data to control vertical movement of the platform relative to the tubular string and to control vertical movement of the roughneck relative to the platform to position the roughneck at a location of a seam or connection of the tubular string to facilitate a tripping operation of the tubular string comprising the segment by activating the tripping slips to engage the tubular string in conjunction with operation of the roughneck during the tripping operation, wherein the control system generates the output data based on position information and a time information each related to the seam or connection of the tubular string as a first reference frame of a plurality of reference frames generated based upon relative movements of respective components of a rig including at least a portion of a lifting system, when a result of a comparison between one or more predetermined values of a thickness of the tubular segment of the tubular string and a processed signal that is based upon the signal indicative of the physical characteristic meets or exceeds a predetermined threshold value.

19. The apparatus of claim 18, wherein the control system is configured to generate a second indication to cause the roughneck at the location of the seam or connection of the tubular string initiate a make-up or break-out of the segment as part of the tripping operation.

* * * * *